US011773532B2

(12) United States Patent
Te Velde

(10) Patent No.: US 11,773,532 B2
(45) Date of Patent: Oct. 3, 2023

(54) WATER DELIVERY APPARATUS

(71) Applicant: KONINKLIJKE PHILIPS N.V., Eindhoven (NL)

(72) Inventor: Mart Kornelis-Jan Te Velde, Helmond (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 62 days.

(21) Appl. No.: 17/417,134

(22) PCT Filed: Jan. 2, 2020

(86) PCT No.: PCT/EP2020/050001
§ 371 (c)(1),
(2) Date: Jun. 22, 2021

(87) PCT Pub. No.: WO2020/144092
PCT Pub. Date: Jul. 16, 2020

(65) Prior Publication Data

US 2022/0074124 A1 Mar. 10, 2022

(30) Foreign Application Priority Data

Jan. 10, 2019 (EP) ..... 19151098

(51) Int. Cl.
*D06F 75/18* (2006.01)
*F22B 27/16* (2006.01)
(Continued)

(52) U.S. Cl.
CPC ..... *D06F 75/18* (2013.01); *F22B 1/287* (2013.01); *F22B 27/16* (2013.01); *F22B 37/60* (2013.01)

(58) Field of Classification Search
CPC ..... D06F 75/00–40; F22B 1/287; F22B 1/28; F22B 1/284; F22B 1/285; F22B 27/16; F22B 27/00; F22B 27/165; F22B 37/60
See application file for complete search history.

(56) References Cited

U.S. PATENT DOCUMENTS 2,620,576 A * 12/1952 Stevenson ..... D06F 75/32 38/77.83
4,535,556 A * 8/1985 Cavalli ..... D06F 75/12 38/77.8
(Continued)

FOREIGN PATENT DOCUMENTS

CN 201715478 U 1/2011
CN 202064212 U 12/2011
(Continued)

OTHER PUBLICATIONS

International Search Report dated Mar. 10, 2020.
(Continued)

*Primary Examiner* — Ismael Izaguirre
(74) *Attorney, Agent, or Firm* — Maschoff Brennan

(57) ABSTRACT

A water delivery apparatus (100) for use at a household appliance is provided. The water apparatus comprises an air-tight water storage unit (110) configured to store water, an air channel (120) configured to allow air to enter the water storage unit at a predetermined height level so as to regulate the water pressure in the water storage unit, and a water delivery tube (130) connected to a component of the household appliance at which water is utilized for performing a function of the household appliance.

12 Claims, 3 Drawing Sheets

(51) Int. Cl.
*F22B 37/60* (2006.01)
*F22B 1/28* (2006.01)

(56) References Cited

U.S. PATENT DOCUMENTS

| | | | | |
|---|---|---|---|---|
| 5,430,963 | A * | 7/1995 | Kuo-Chu | D06F 75/18 38/77.83 |
| 6,176,026 | B1 * | 1/2001 | Leung | D06F 79/026 38/96 |
| 2011/0215085 | A1 | 9/2011 | Garvey | |
| 2016/0053429 | A1 | 2/2016 | Stamper | |
| 2017/0020323 | A1 | 1/2017 | Freeman | |

FOREIGN PATENT DOCUMENTS

| | | | |
|---|---|---|---|
| CN | 105747885 | A | 7/2016 |
| CN | 107604621 | A | 1/2018 |
| CN | 108644948 | A | 10/2018 |
| CN | 108914521 | A | 11/2018 |
| EP | 0493765 | A2 | 7/1992 |
| JP | 59075096 | A * | 4/1984 |

OTHER PUBLICATIONS http://www.eng.nus.edu.sg/mpelimtt/Karman1.JPG.
http://www.eng.nus.edu.sg/mpelimtt/collision.mpg.
http://www.eng.nus.edu.sg/mpelimtt/leapfrog.mpg.
http://www.eng.nus.edu.sg/mpelimtt/collid998.JPG.

* cited by examiner

WATER DELIVERY APPARATUS

CROSS REFERENCE TO RELATED APPLICATIONS

This application is the U.S. National Phase application under 35 U.S.C. § 371 of International Application No. PCT/EP2020/050001 filed Jan. 2, 2020, which claims the benefit of European Patent Application Number 19151098.1 filed Jan. 10, 2019. These applications are hereby incorporated by reference herein.

FIELD OF THE INVENTION

The present disclosure relates to a water delivery apparatus for use at a household appliance. The present disclosure also relates to a household appliance comprising a water delivery apparatus and a steam generating unit.

BACKGROUND OF THE INVENTION

In many currently known household appliances which involve the use of water or steam, such as coffee appliances, steam cleaners, irons with steam generators, a water reservoir and a water pump are provided for the purpose of controlling and directing a water flow within the appliance. The water pump provided in these appliances is typically a solenoid pump which typically adds to the costs of manufacture and maintenance. Moreover, most of the water pumps (e.g. solenoid pumps) currently used in these household appliances make undesired noise during operation.

SUMMARY OF THE INVENTION

As noted above, there are a number of disadvantages associated with the currently available water delivery techniques used in household appliances, such as high manufacturing and maintenance costs associated with the use of water pumps and/or unwanted noises. It would therefore be advantageous to provide an improved water delivery apparatus for use at a household appliance which address these disadvantages.

To better address one or more of the concerns mentioned earlier, in a first aspect, a water delivery apparatus for use at a household appliance is provided. The water apparatus comprises: an air-tight water storage unit configured to store water; an air channel configured to allow air to enter the water storage unit at a predetermined height level so as to regulate the water pressure in the water storage unit; and a water delivery tube comprising a first end and a second end, wherein the first end is connected to the water storage unit, and the second end is connected to a component of the household appliance at which water is utilized for performing a function of the household appliance. The water delivery tube is arranged such that its second end is lower than the predetermined height level, and the height difference causes water to flow from the water storage unit to the component of the household appliance, and the rate of water flow from the water storage unit to the component is based on at least one of: the extent of the height difference, the inner diameter of the water delivery tube, and the length of the water delivery tube.

In some embodiments, the water delivery apparatus may further comprise a flow adjustment unit arranged at the water delivery tube. The flow adjustment unit may be further configured to reduce or increase the inner diameter of at least a part of the water delivery tube. In these embodiments, the flow adjustment unit may comprise a restriction element having an orifice, the orifice having a smaller diameter than the inner diameter of the water delivery tube. Therefore the rate of water flow from the water storage unit to the component may be further based on the dimensions of the restriction element (which controls the inner diameter of the water delivery tube.

In some embodiments, the water delivery tube may be configured such that its length can be adjusted.

In some embodiments, the water delivery apparatus may further comprise a control unit configured to adjust, based on a user input, at least one of the diameter of at least a part of the water delivery tube and the length of the water delivery tube.

In some embodiments, the air channel may be a hollow tube vertically arranged at the water storage unit, the hollow tube having a top end located external to the water storage unit and a bottom end arranged to be submerged in the water stored in the water storage unit, and the height difference between the bottom end of the hollow tube and the second end of the water delivery tube causes water to flow from the water storage unit to the component of the household appliance. In these embodiments, the water storage unit may further comprise: a top opening through which the hollow tube is arranged, and an air-tight covering element arranged to cover the top opening. Furthermore, in these embodiments, the water delivery apparatus may further comprise an air valve arranged at the top end of the hollow tube configured to selectively allow air flow such that water flow via the water delivery tube can be initiated or stopped. The air valve may be a manually or electronically operable control valve which can be controlled to vary the size of its air flow passage. Also, the air valve may be configured to be controlled by actuation of an actuation unit.

In some embodiments, the air channel may be a level chamber arranged adjacent to the water storage unit. The level chamber may be connected to the water storage unit through a shared opening and the first end of the water delivery tube is connected to the level chamber, wherein the height difference between the shared opening and the second end of the water delivery tube causes water to flow from the water storage unit to the component of the household appliance.

In a second aspect, there is provided a household appliance comprising: the water delivery apparatus as described herein, and a steam generating unit, wherein the steam generating unit is the component of the household appliance at which water is utilized. In some embodiments, the household appliance may be a steam iron.

According to the aspects and embodiments described above, the limitations of existing techniques are addressed. In particular, the above-described aspects and embodiments enable efficient and cost effective water delivery functionality to be realized within a household appliance without creating unwanted noise during operation of the household appliance. There is thus provided an improved water delivery apparatus and a household appliance comprising a water delivery apparatus.

These and other aspects of the disclosure will be apparent from and elucidated with reference to the embodiment(s) described hereinafter.

BRIEF DESCRIPTION OF THE DRAWINGS

For a better understanding of the embodiments, and to show more clearly how they may be carried into effect, reference will now be made, by way of example only, to the accompanying drawings, in which.

DETAILED DESCRIPTION OF EMBODIMENTS

As noted above, there is provided an improved water delivery apparatus and a household appliance which address the existing problems.

Figure 1:
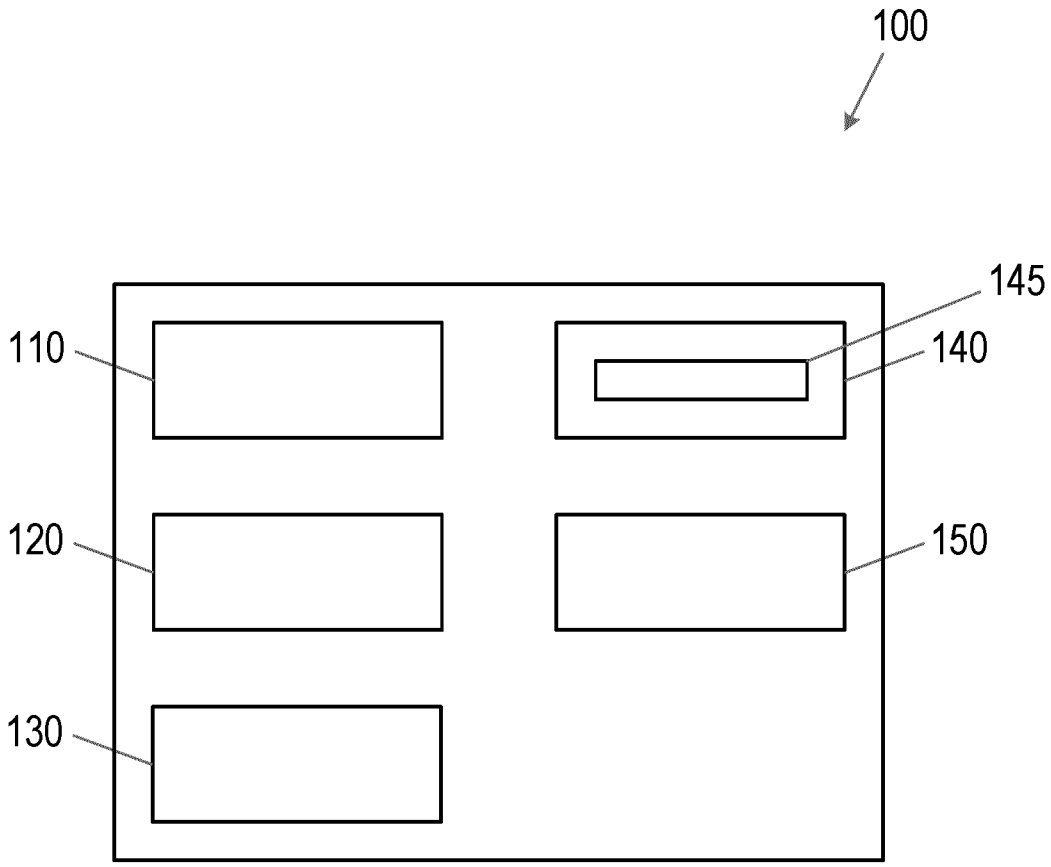
FIG. 1 is a block diagram of a water delivery apparatus according to an embodiment.

FIG. 1 shows a block diagram of a water delivery apparatus 100 according to an embodiment, which can be implemented at a household appliance that makes use of water and/or steam in its typical functions, such as coffee appliances, steam cleaners, irons with steam generators, etc. The water delivery apparatus 100 comprises a water storage unit 110, an air channel 120, a water delivery tube 130, a flow adjustment unit 140, and a control unit 150. The water storage unit 110 is an air-tight container configured to store water. In some embodiments, the water storage unit 110 may be connected to a water supply.

Figure 2:
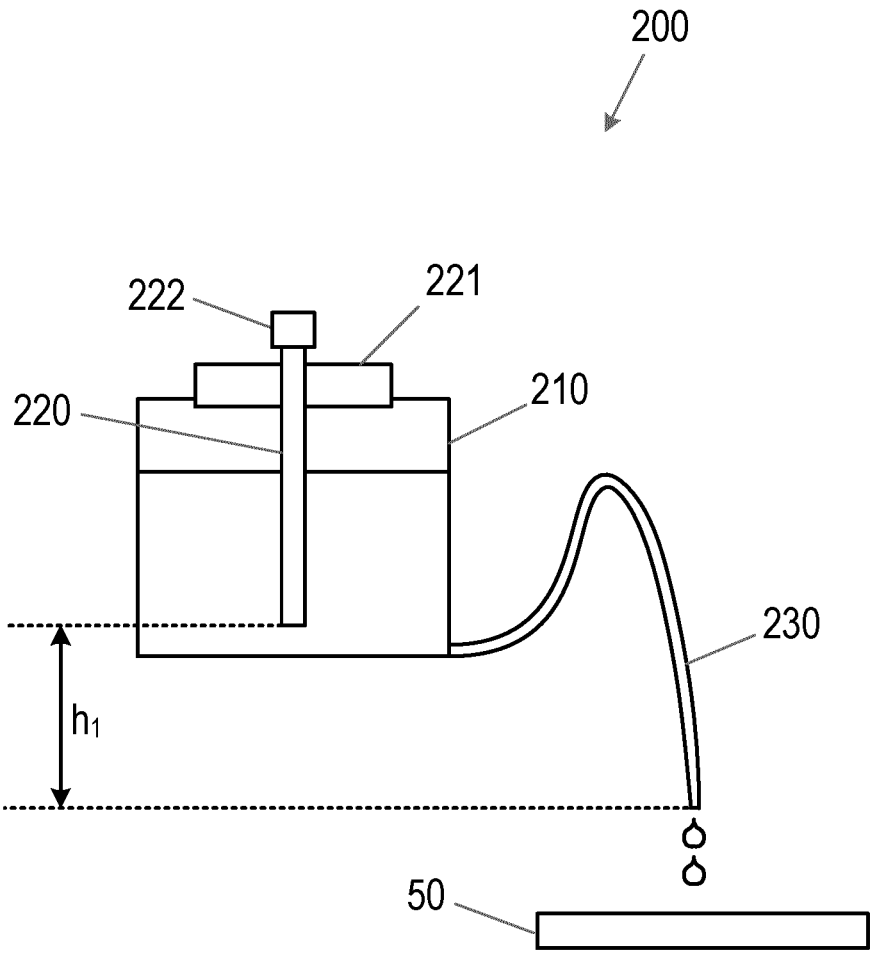
FIG. 2 illustrates a water delivery apparatus and a component at a household appliance, according to an embodiment.

The air channel 120 is configured to allow air to enter the water storage unit 110 at a predetermined height level so as to regulate the water pressure in the water storage unit 110. In some embodiments, the air channel may be hollow tube. An example of these embodiments is illustrated in FIG. 2. In these embodiments, the hollow tube may be vertically arranged at the water storage unit 110. The hollow tube may have a top end located external to the water storage unit 110 and a bottom end arranged to be submerged in the water storage in the water storage unit 110. Moreover, in these embodiments, the water storage unit 110 may comprise a top opening through which the hollow tube is arranged, and an air-tight covering element (e.g. a lid) arranged to cover the top opening of the water storage unit 110.

Figure 3:
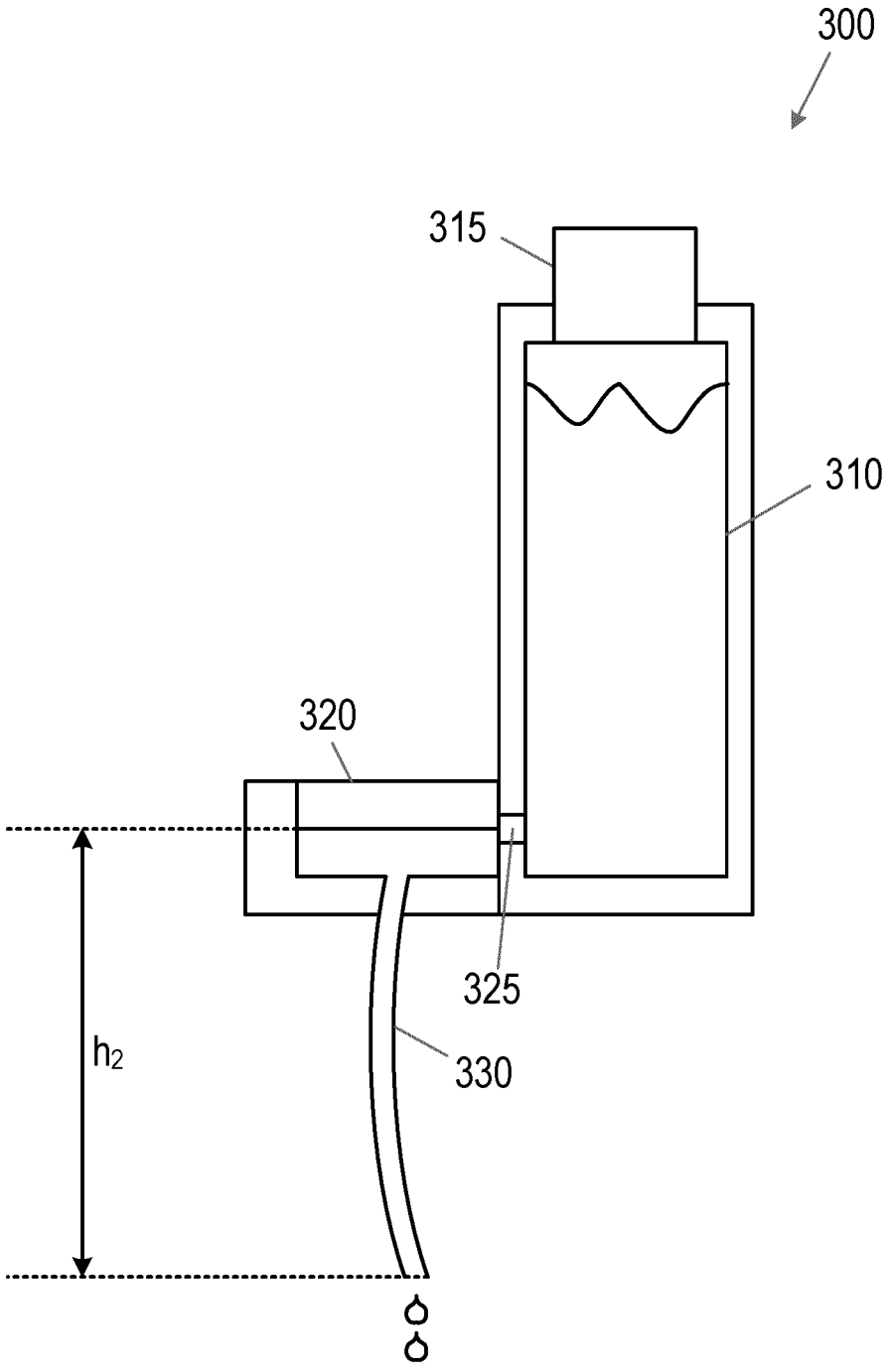
FIG. 3 illustrates a water delivery apparatus according to another embodiment.

In some alternative embodiments, instead of a hollow tube, the air channel may be a level chamber arranged adjacent to the water storage unit 110. An example of these embodiments is illustrated in FIG. 3.

The water delivery tube 130 is configured to deliver water from the water storage unit 110 to a component of the household appliance at which water is utilized for performing a function of the household appliance. For example, the component may be a steam generating unit (e.g. a heating plate) at a steam iron. The water delivery tube 130 comprises a first end and a second end, the first end being connected to the water storage unit 110 and the second end being connected to the component at which water is utilized. In some embodiments where the air channel is implemented as a level chamber, the first end may be connected to the water storage unit 110 through the level chamber. In other words, the water stored in the water storage unit 110 may enter the level chamber before being delivered through the water delivery tube 130 to the component of the household appliance.

As will be explained in more detail with reference to FIG. 2 and FIG. 3, the water delivery tube 130 is arranged such that its second end is lower than the predetermined height level at which the air channel 120 allows air to enter the water storage unit 110. This height difference between the predetermined height level at which the air channel 120 allows air to enter the water storage unit 110 and the second end of the water delivery tube 130 would cause water to flow, by gravity, from the water storage unit 110 to the component of the household appliance. In this case, the rate of water flow from the water storage unit 110 to the component is based on at least one of: the extent of the height difference, the inner diameter of the water delivery tube 130, and the length of the water delivery tube 130.

To demonstrate how the rate of water flow from the water storage unit 110 varies based on the factors as mentioned above, an experiment was conducted in which three different water delivery tubes having different lengths and height differences (between the second end of the water delivery tube and the predetermined height level at which the air channel allows air to enter the water storage unit) are used in conjunction with a water reservoir. Specifically, in the experiment, the first end of a different water delivery tube is connected to the bottom of the water reservoir each time, and rate of water flow out of the second (open) end is measured. In this case, the difference in height between the water level in the water reservoir and the second end of the water delivery tube is regarded as equivalent to the height difference between the predetermined height level at which the air channel 120 allows air to enter the water storage unit 110 and the second end of the water delivery tube 130 of FIG. 1. The measured water flow rates are delineated in Table 1 below.

TABLE 1

Results of the experiment using water delivery tubes in different set-ups.

| Water delivery tube # | Height difference (mm) | Length of the water delivery tube (mm) | Rate of water flow (ml/min) |
|---|---|---|---|
| 1 | 130 | 430 | 10 |
| 2 | 65 | 430 | 4.7 |
| 3 | 65 | 215 | 9.5 |

By comparing the results of water delivery tubes #1 and #3 in Table 1, it can be appreciated that the larger the height difference between the water level in the water reservoir and the second end of the water delivery tube, the higher the rate of water flow in the water delivery tube. By comparing the results of water delivery tubes #2 and #3, it can be appreciated that the shorter the length of the water delivery tube, the higher the rate of water flow in the water delivery tube. Since the height difference in this experiment (i.e. the height difference between the water level in the water reservoir and the second end of the water delivery tube) essentially provides the same effect as the height difference in the present embodiment (i.e. the height difference between the predetermined height level at which the air channel 120 allows air to enter the water storage unit 110 and the second end of the water delivery tube 130), it will be understood that the rate of water flow in the water delivery tube 130 of the present embodiment can be controlled by controlling at least one of: the extent of the height difference, the inner diameter of the water delivery tube 130, and the length of the water delivery tube 130.

As described above, in some embodiments the air channel 120 may be a hollow tube arranged vertically at the water storage unit 110. In these embodiments, the height difference between the bottom end of the hollow tube and the second end of the water delivery tube 130 would cause water to flow from the water storage unit 110 to the component of the household appliance. In addition, in these embodiments, the water delivery apparatus 100 may further comprise an air valve arranged at the top end of the hollow tube configured to selectively allow air flow such that water flow via the water delivery tube 130 can be initiated or stopped. The air valve may be manually or electronically operable control valve which can be controlled to vary the size of its air flow passage and/or to open and close. Also, the air valve may be configured to be controlled by actuation of an actuation unit. For example, a button may be provided at the top end of the hollow tube and upon actuation of the button the air valve may be controlled (e.g. to open or close the valve).

As mentioned above, in some embodiments the air channel may be a level chamber arranged adjacent to the water storage unit 110. In these embodiments, the level chamber may be connected to the water storage unit 110 through a shared opening, and the first end of the water delivery tube 130 may be connected to the level chamber. In this case, the height difference between the shared opening and the second end of the water delivery tube 130 would cause water to flow from the water storage unit 110 to the component of the household appliance by gravity.

In some embodiments, the water delivery tube 130 may be configured such that its length can be adjusted. For example, the water delivery tube 130 may have a telescopic configuration which can be manually operated so as to shorten or lengthen the water delivery tube 130. As another example, the water delivery tube may comprise of a plurality of inter-connectable tube parts and the number of tube parts may be selected based on a desired length. It will be appreciated that other types of configuration may be possible for implementing a length-adjustable water delivery tube.

The flow adjustment unit 140 is arranged at the water delivery tube 130, and is configured to reduce or increase the inner diameter of at least a part of the water delivery tube 130. In this embodiment, the flow adjustment unit 140 comprises a restriction element 145 having an orifice, the orifice having a smaller diameter than the inner diameter of the water delivery tube 130.

The control unit 150 is configured to adjust, based on user input, at least one of the diameter of at least a part of the water delivery tube 130 and the length of the water delivery tube 130. The user input may be received via a user interface provided at the household appliance. In this case, the control unit 150 may be implemented as a part of a control unit of the household appliance. In some embodiments, the user input may indicate a usage mode of the household appliance. For example, a user may press a button at the user interface of the household appliance indicating an "eco mode" in which water consumption is intended to be lower than a normal operation mode, and based on this input the control unit 150 may be configured to adjust (e.g. decrease) the diameter of at least a part of the water delivery tube 130 so as to reduce the rate of water flow in the water delivery tube 130. In some embodiments, the control unit 150 may be configured to control the flow adjustment unit 140 in order to adjust the diameter of at least a part of the water delivery tube 130.

Although it is described above that the water delivery apparatus 100 comprises a flow adjustment unit 140 and a control unit 150, in alternative embodiments the water delivery apparatus 100 may not necessarily comprise a flow adjustment unit or a control unit. In particular, in embodiments where the water delivery tube 130 is implemented such that it is length-adjustable, a flow adjustment unit may not be necessary. Also, in some embodiments the household appliance may comprise a control unit, and the control unit may be configured to perform the functions described above with respect to the control unit 150. In these embodiment, the water delivery apparatus 100 may not necessarily comprise a control unit.

It will be appreciated that FIG. 1 only shows the components required to illustrate an aspect of the water delivery apparatus 100, and in a practical implementation, the water delivery apparatus 100 may comprise alternative or additional components to those shown.

Moreover, it will be appreciated that in some embodiments a household appliance may be provided. The household appliance may comprise the water delivery apparatus 100 as described above. The household appliance may further comprise a component at which water is utilized for performing a function of the household appliance. For example, this component may be a steam generating unit (e.g. a heating plate).

FIG. 2 illustrates a water delivery apparatus 200 and a component 50 of a household appliance, according to an embodiment. In this embodiment, the water delivery apparatus 200 comprises a water storage unit 210, an air channel 220, a covering element 221, an air valve 222, and a water delivery tube 230. The water delivery apparatus 300 is for use at a household appliance, such as a steam cooker, and the component 50 of the household appliance in this embodiment is a heating plate configured to generate steam.

The water storage unit 210 and the air channel 220 in the present embodiment are implemented as a water reservoir having a hollow tube (e.g. a straw) arranged vertically at the water storage unit 210. The covering element 221 comprises an air-tight lid that is configured to cover a top opening of the water storage unit 210 so as to maintain a constant air pressure level inside the water storage unit 210. In some embodiments, the covering element 221 may be configured to be removable from the water storage unit 210 so that water can be introduced into the water storage unit 210 (for example, manually by a user). The hollow tube 220 has a top end that is located external to the water storage unit 210 and a bottom end arranged to be submerged in the water stored in the water storage unit 210. Specifically, as shown in FIG. 2, the hollow tube 220 has been inserted through an opening of the water storage unit 210 and an aperture (not shown in the drawing) of the covering element 221 in an air-tight manner, such that its top end is above the covering element 221 and its bottom end is under the covering element inside the water storage unit 210. As will be described in more detail in the paragraph below, air can enter the water storage unit 210 through the air channel 220 so as to regulate the water pressure in the water storage unit 210. Therefore, in this embodiment, the bottom end of the hollow tube corresponds to a predetermined height level at which air is allowed to enter the water storage unit 210.

The air valve 222 is provided at the top end of the hollow tube 220, the air valve being configured to selectively allow air flow between the interior of the water storage unit 210 and the external surroundings of the water delivery apparatus 200. In the present embodiment, when the air valve is open, the difference in air pressure between the interior of the water storage unit 210 and the external surroundings would cause air flow from the external surroundings into the water storage unit 210 through the hollow tube 220. This air flow into the water storage unit 210 would in turn regulate the water pressure in the water storage unit 210 such that water can flow from the water storage unit 210 to the heating plate 50 via the water delivery tube 230 by gravity. When the air valve is closed, no air flow is allowed between the interior of the water storage unit 210 and the external surroundings, and consequently the maintenance of the air pressure within the water storage unit 210 would prevent water from flowing out of the water storage unit 210 via the water delivery tube 230. In some embodiments, the air valve may be a manually or electronically operable control valve which can be controlled to vary the size of its air flow passage and/or to open and close. In some embodiments, the air valve may be configured to be controlled by actuation of an actuation unit (e.g. a button provided at the air channel 220), e.g. to open and close.

Similar to the water delivery tube 130 as described with reference to FIG. 1, the water delivery tube 230 in this embodiment also comprises a first end and a second end. The first end is connected to the water storage unit 210 and the second end is connected to the heating plate 50 of the household appliance. As mentioned above, in the present embodiment the bottom end of the hollow tube 220 corresponds to the predetermined height level at which air is allowed to enter the water storage unit 210. It is further shown in FIG. 2 that the second end of the water delivery tube 230 lower than this predetermined height level. The height difference between the bottom end of the hollow tube 220 and the second end of the water delivery tube 230 is labelled as $h_1$ in FIG. 2. This height difference $h_1$ causes water to flow from the water storage unit 210 to the heating plate 50 of the household appliance by gravity. In more detail, in this embodiment water delivered via the water delivery tube 230 is dripped onto the heating plate 50 such that steam can be generated.

As explained above with reference to FIG. 1, the rate of water flow from the water storage unit 210 to the heating plate 50 is based on at least one of: the extent of the height difference $h_1$, the inner diameter of the water delivery tube 230, and the length of the water delivery tube 230. Hence, the water delivery apparatus 200 can be designed and manufactured in accordance to the specific requirements of the household appliance. Furthermore, the water delivery apparatus 200 may further comprise a flow adjustment unit and/or a control unit such as those described above with reference FIG. 1 so as to allow dynamic adjustment of water flow within the household appliance.

FIG. 3 illustrates a water delivery apparatus 300 according to another embodiment. In this embodiment, the water delivery apparatus 300 comprises a water storage unit 310, an air channel 320, a water delivery tube 330, and a covering element 315. The water delivery apparatus 300 is for use at a household appliance, such as a steam cooker.

The water storage unit 310 and the air channel 320 in the present embodiment are implemented as a water reservoir having an adjacent level chamber. The level chamber 320 in this embodiment is arranged in a side-by-side arrangement such that it is connected to the water storage unit 310 through a shared opening 325. In other words, the shared opening 325 allows water and air passage between the water storage unit 210 and the level chamber 320. The covering element 315 comprises an air-tight seal that is configured to cover a top opening of the water storage unit 310 so as to maintain an air pressure level inside the water storage unit 310. Since the air inside the level chamber 320 can enter the water storage unit 320 through the shared opening 325 to regulate the water pressure inside the water storage unit 320, the shared opening 325 corresponds to a predetermined height level at which air is allowed to enter the water storage unit 310.

Similar to the water delivery tube 130 as described with reference to FIG. 1, the water delivery tube 330 in this embodiment also comprises a first end and a second end. As shown in FIG. 3, the first end of the water delivery tube 330 is connected to the water storage unit 310 through the level chamber 320. In other words, water from the water storage unit 310 can be directed into the water delivery tube 330 after it enters the level chamber 320. Although not explicitly illustrated in FIG. 3, the second end of the water delivery tube 330 is connected to a component of the household appliance at which water is utilized for performing a function of the household appliance, such as a steam generating unit.

As mentioned above, in the present embodiment the shared opening 325 between the level chamber 320 and the water storage unit 310 corresponds to the predetermined height level at which air is allowed to enter the water storage unit 310. It is further shown in FIG. 3 that the second end of the water delivery tube 330 lower than this predetermined height level. This height difference between the shared opening 325 and the second end of the water delivery tube 330 is labelled as $h_2$ in FIG. 3. This height difference $h_2$ causes water to flow from the water storage unit 310 (and the level chamber 320) by gravity towards the component of the household appliance. In some embodiments, the water delivered via the water delivery tube 330 may be dripped onto a heating element such that steam can be generated.

As explained above with reference to FIG. 1, the rate of water flow from the water storage unit 310 via the water delivery tube 320 is based on at least one of: the extent of the height difference $h_2$, the inner diameter of the water delivery tube 330, and the length of the water delivery tube 330. Hence, the water delivery apparatus 300 can be designed and manufactured in accordance to the specific requirements of the household appliance. Furthermore, the water delivery apparatus 300 may further comprise a flow adjustment unit and/or a control unit such as those described above with reference FIG. 1 so as to allow dynamic adjustment of water flow within the household appliance.

Although it is described above that the covering element 315 is an air-tight seal, it will be appreciated that in some embodiments alternative types of arrangement(s) may be implemented to provide the same function as the covering element 315. For example, in some embodiments the covering element 315 may be a removable air-tight lid so that water can be introduced into the water storage unit 310 (for example, manually by a user)

There is thus provided an improved water delivery apparatus for use at a household appliance. There is also provided an improved household appliance comprising a water delivery apparatus and a component at which water is utilized for performing a specific function (e.g. steam generation).

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A water delivery apparatus for use at a household appliance, the water delivery apparatus comprising:

an air-tight water storage unit configured to store water;

an air channel configured to allow air to enter the water storage unit at a predetermined height level so as to regulate the water pressure in the water storage unit; and a water delivery tube comprising a first end and a second end, wherein the first end is connected to the water storage unit, and the second end is connected to a component of the household appliance at which water is utilized for performing a function of the household appliance; and a flow adjustment unit arranged at the water delivery tube, the flow adjustment unit being configured to reduce or increase an inner diameter of at least a part of the water delivery tube, wherein the water delivery tube is arranged such that its second end is lower than the predetermined height level, and a height difference causes water to flow from the water storage unit to the component of the household appliance, and rate of water flow from the water storage unit to the component of the household appliance is based on at least one of: an extent of the height difference, the inner diameter of the water delivery tube, and a length of the water delivery tube.

2. The water delivery apparatus according to claim 1, wherein the flow adjustment unit comprises a restriction element having an orifice, the orifice having a smaller diameter than the inner diameter of the water delivery tube.

3. The water delivery apparatus according to claim 1, wherein the water delivery tube is configured such that its length can be adjusted.

4. The water delivery apparatus according to claim 1, further comprising a control unit configured to adjust, based on a user input, at least one of the inner diameter of at least the part of the water delivery tube and the length of the water delivery tube.

5. The water delivery apparatus according to claim 1, wherein the air channel is a hollow tube vertically arranged at the water storage unit, the hollow tube having a top end located external to the water storage unit and a bottom end arranged to be submerged in the water stored in the water storage unit, and the height difference between the bottom end of the hollow tube and the second end of the water delivery tube causes water to flow from the water storage unit to the component of the household appliance.

6. The water delivery apparatus according to claim 5, wherein the water storage unit comprises:

a top opening through which the hollow tube is arranged; and an air-tight covering element arranged to cover the top opening.

7. The water delivery apparatus according to claim 5, further comprising an air valve arranged at the top end of the hollow tube configured to selectively allow air flow such that water flow via the water delivery tube can be initiated or stopped.

8. The water delivery apparatus according to claim 7, wherein the air valve is a manually or electronically operable control valve which can be controlled to vary the size of its air flow passage.

9. The water delivery apparatus according to claim 7, wherein the air valve is configured to be controlled by actuation of an actuation unit.

10. The water delivery apparatus according to claim 1, wherein the air channel is a level chamber arranged adjacent to the water storage unit, wherein the level chamber is connected to the water storage unit through a shared opening and the first end of the water delivery tube is connected to the level chamber, and wherein the height difference between the shared opening and the second end of the water delivery tube causes water to flow from the water storage unit to the component of the household appliance.

11. A household appliance comprising:

the water delivery apparatus according to claim 1; and a steam generating unit, wherein the steam generating unit is the component of the household appliance at which water is utilized.

12. The household appliance according to claim 11, wherein the household appliance is a steam iron.

* * * * *